United States Patent [19]

Nishikubo et al.

[11] 4,070,893

[45] Jan. 31, 1978

[54] FINISH ROLLING METHOD FOR PRODUCTION OF ROUND CROSS-SECTIONAL SHAPE MATERIALS

[75] Inventors: Michio Nishikubo; Sei Miura; Toshiaki Toyoda; Katsunori Jonishi; Kouichi Yoneta, all of Muroran, Japan

[73] Assignee: Nippon Steel Corporation, Tokyo, Japan

[21] Appl. No.: 753,882

[22] Filed: Dec. 23, 1976

[51] Int. Cl.[2]..... B21B 1/12

[52] U.S. Cl. ..... 72/234

[58] Field of Search ..... 72/234, 235, 366, 226

[56] References Cited

U.S. PATENT DOCUMENTS

| | | | |
|---|---|---|---|
| 3,556,657 | 3/1971 | Blinn | 72/234 |

FOREIGN PATENT DOCUMENTS

| | | | |
|---|---|---|---|
| 1,282,582 | 1/1968 | Germany | 72/234 |
| 603,554 | 4/1960 | Italy | 72/235 |
| 7,009,630 | 1/1971 | Netherlands | 72/226 |

*Primary Examiner*—Milton S. Mehr

*Attorney, Agent, or Firm*—Toren, McGeady and Stanger

[57] ABSTRACT

In the rolling of metal material to round cross-sectional shape through a succession of three roll stands with the horizontal-horizontal-vertical, or vertical-vertical-horizontal rolls arranged in this order in the rolling down direction for achievement of increased accuracy of dimensional control at finish, an initial metal stock of specific oval cross-section is rolled to an intermediate and small reduction through the first and second stands forming specific oval groove, and then to a finish and small reduction through the third stand forming a round groove.

1 Claim, 9 Drawing Figures

FINISH ROLLING METHOD FOR PRODUCTION OF ROUND CROSS-SECTIONAL SHAPE MATERIALS

BACKGROUND OF THE INVENTION

This invention relates to a method of rolling metal materials to round cross-sectional shape, and more particularly to improvements of the rolling method with respect to the accuracy of dimensional control for finish gauge.

In the rolling of metals such as steel to a round cross-sectional shape, attempts have been made to increase the accuracy of dimensional control for finish gauge by removing tension from the work being rolled in such a manner, as, for example, to permit formation of a loop between successive two roll stands, or, upon detection of the tension to automatically control the peripheral speed of the work roll. These methods are, however, because they fundamentally suffer from the limitation of the response speed and reliability of automatic control and are not suitable for use in achieving additional improvement of the accuracy of dimensional control over the heretofore attained level of about +0.2 to about +0.4 mm, depending upon the sizes of rolled products. Also, there are disadvantages of increasing the cost of equipment necessary to perform them, and of requiring additional spare wide floor space on which the equipment is to be installed. Further, significant numbers of rolling situations are encountered where secondary working operations will be found necessary as the heretofore attained level of dimensional control is not sufficiently high. For example, a considerable percentage of metal bars and wires after having been finish rolled must be further subjected to drawing or likewise forming applications.

Where a small reduction is desired, it is impossible to use the conventional rolling method adapted to produce a round cross-sectional shape, because this method must be operated with a large reduction which in turn calls for a large increase in the diameter of the work roll with the corresponding increase in the distance between the successive grooves. This leads to a high probability of the occurrence of twist in the work being rolled so that the percentage of rolled products which will be found acceptable with respect to the finish dimensions is decreased.

On the other hand, Morgan block mills are known which are representative of the various types of block mills used in the intermediate and/or finish rolling of steel material, but their primary aim is to achieve the speed-up of production run and the compactness of the mill equipment itself with the help of employing a relatively axial ratio of the oval groove, so that the reduction can not be limited to small orders. Thus, the deviation of the actual values of the dimensions of the finished products from the specific and ideal ones is of the order of ±0.2 mm. In addition thereto, it is recognized that it is necessary to provide an entrance roller guide positioned in front of a finishing groove for the purpose of preventing impartment of twist to the work being rolled.

SUMMARY OF THE INVENTION

Accordingly, the present invention has for the general object to provide a novel finish rolling method for production of round cross-sectional shapes with high accuracy of dimensional control at the finish. The features which may be considered to be characteristic of the present invention will be explained below.

The first feature effective particularly when applied to the finish rolling of steel material is to employ a train of three roll stands with the first stand being of the horizontal roll type, the second stand being of the horizontal roll type and the third stand being of the vertical roll type, or an alternative train of the vertical-vertical-horizontal roll types, arranged adjacent to each other in this order in the rolling direction.

The second feature is that the first and second stands are provided with respective passes of oval rolling configuration (groove), or a groove having similar functions thereto, specified, in terms of the axial ratio, i.e. ratio of the major diameter to the minor diameter, of the cross-sectional area of an intermediate so produced, as ranging from 1.09 to 1.31 for subsequent rolling to a finish gauge which falls within a range of not less than 5 mm to less than 40 mm in diameter (hereinafter abbreviated as "finish gauge of low level"), and as ranging from 1.05 to 1.21 for subsequent rolling to a finish gauge which falls within a range of 40 mm to 200 mm in diameter (hereinafter abbreviated as "finish gauge of high level"), while the third stand is provided with a round or likewise groove.

In order to maintain the above axial ratio, the dimensions of grooves of the first and the second stands are defined below:

1. when a final product of 5 to not larger than 40 mm diameter is to be obtained Major diameter:

$$(1.1412D + 2.20)\text{mm} \sim (1.1256D + 1.95)\text{ mm}$$

Minor diameter:

$$(0.985D - 0.1)\text{mm} \sim 0.998D\text{mm}$$

2. when a final product of 40 to not larger than 200 mm diameter is to be obtained Major diameter:

$$(1.0912\ D + 4.02)\text{mm} \sim (1.153D + 6.15)\text{mm}$$

Minor diameter:

$$0.985D \sim 0.998D$$

in which D represents a distance between two points at which a straight line perpendicular to the roll gap center line and passing through a central point of the groove intersects the upper and lower roll profile curves in the final stand.

The third feature is that the dimensions of the cross-sectional area of the starting rolling stock are limited to specific values for the major and minor axes. For the rolling to the finish gauge of low level, there are given a range of 1.07D + 0.5 mm to 1.18D + 0.4 mm for the major axis, and a range of 1.01D + 0.2 mm to 1.05D + 0.4 mm for the minor axis. For the rolling to the finish gauge of high level, there are given a range of 1.04D + 1.5 mm to 1.10D + 3.5 mm for the major axis, and a range of 1.01D + 0.2 mm to 1.02D + 1.5 mm for the minor axis. D represents a distance between two points at which a line perpendicular to the roll gap center line and passing through a central point of the groove intersects the upper and lower roll profile curves in the final stand.

As the fourth feature, the first and second stands are provided with respective passes of oval likewise grooves with the values of the major diameter thereof being in a range of 1.1412D + 2.02 mm to 1.2565D + 1.95 mm and the minor diameter thereof being in a range of (0.985D-0.1) mm to 0.998D mm for the final gauge of low level and in a range of 1.0912D + 4.02 mm to 1.1535D + 6.15 mm and in a range of 0.985D mm to 0.998D mm for the final gauge of high level.

The fifth feature is that all the roll stands are positioned as spaced apart from each other along a common pass axis with a very short distance. In numerical terms, the roll axis separation between the first and second stands is made shorter than (5.6D + 400) mm; while the roll axis separation between the second and third stands is made shorter than (4.6D + 320) mm.

DETAILED DESCRIPTION OF THE INVENTION

Figure 1:
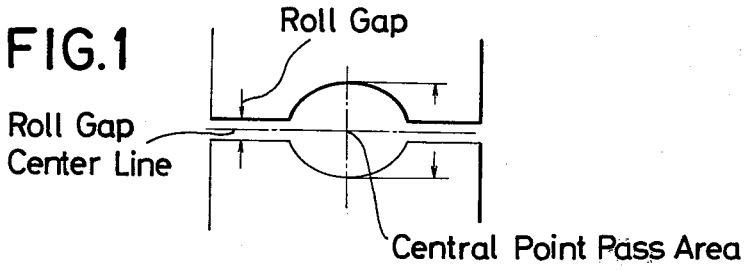
FIG. 1 is a diagram of geometry considered in defining the diameter of finish gauge in the groove of the No. 3 rolling stand.

It is well known that the width expansion of the work being rolled and the work guide adjusting capabilities of the rolling mill depend upon the size of the work. In the present invention, therefore, a variety of operable work sizes are classified into two groups in terms of the size of finish gauge, one group of which is asigned to a range of not less than 5 mm to less than 40 mm (herein referred to as "finish gauge of low level"), and another group which is assigned to a range of 40 mm up to 200 mm inclusive (herein referred to as "finish gauge of high level"). The term "size of finish gauge" herein used refers to the specific dimension defined in connection with FIG. 1, wherein there is shown a pair of horizontal rolls of the No. 3 stand forming a finishing round groove, or likewise groove having an equivalent function thereto. From FIG. 1 on, the distance D between the two points at which a line perpendicular to the roll gap center line and passing through a central point of the pass opening area intersects the upper and lower roll profile curves is identified as the diameter of finish gauge.

The present invention makes use of starting stocks of oval or likewise cross-section which may be manufactured in a conventional manner, as, for example, by the loop control method or by use of any one of the various block mills, or, in some cases, by the control-free rolling method. The term "oval or likewise cross-section" includes oval, cross section, cross-section formed by a pair of central arcs having the same curvature, cross-section formed by a pair of arcs having the same curvature and each having a pair of side arcs at both sides having a different curvature from that of the central arc, and octagonal and hexagon cross-sections. Now hereinafter the above cross-sectional shapes are called simply "oval cross-sectional shape".

Figure 2:
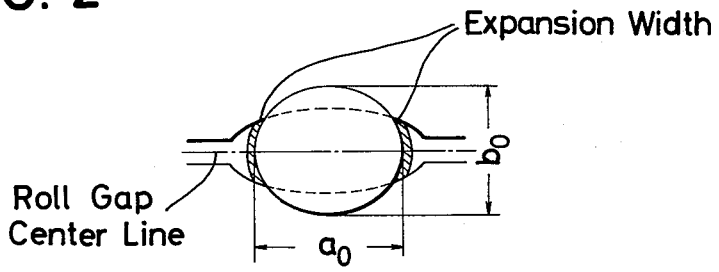
FIG. 2 is a diagram of geometry considered in defining the cross-sectional area of a starting stock as axially aligned with the No. 1 stand.

The starting stock usuable in the present invention is specified with respect to its cross-section before introduction to the initial pass of the rolling mill in terms of three parameters, namely, the major axis, minor axis and major axis-to-minor axis ratio or axial ratio. The definition of these three terms will be understood from FIG. 2, wherein the starting stock is shown as being about to enter the No. 1 stand, while the cross-section of the starting stock is adjusted in angular position relative to the orientation of the No. 1 pass, and wherein the length of the cross-section measured in coincidence with the roll gap center line is designated by $a_0$, and the length of the cross-section measured in coincidence with a line perpendicular to the roll gap center line and passing a central point of the pass opening area is designated by $b_0$. Hence, we call the lengths, $a_0$, and, $b_0$, "major axis" and "minor axis" respectively, and the ratio $a_0/b_0$ "axial ratio". It is required that the axial ratio must be limited to a numerical value ranging from 1.03 to 1.21 for the finish gauge of low level, and otherwise ranging from 1.02 to 1.17 for the finish gauge of high level. It is further required that the major and minor axis for the finish gauge of low level must be limited to respective values ranging from 1.07D + 0.5 mm to 1.18D + 0.4 mm and from 1.01D + 0.2 mm to 1.05D + 0.4 mm respectively, and those for the finish gauge of high level to respective values ranging from 1.04D + 1.5 mm to 1.10D + 3.5 mm from 1.01D + 0.2 mm to 1.02D + 1.5 mm respectively.

The fulfillment of the all above requirements will lead to the possibility of performing that portion of the rolling process which operates with the first and second roll stands without the necessity of using the otherwise necessary entrance roller guide or likewise guide means for sustaining the normal position of the work being rolled while nevertheless preventing impartment of torsion into the work, and further to the possibility of limiting the total reduction from the initial pass to the finishing pass to smaller orders than was previously possible for the purpose of achieving an improvement of the accuracy of dimensional control for the finishes so produced. Another advantage is that whilst the conventional guide method requires no reduction, the first and second stands of the present invention may be operated with a slight reduction of the work so that the intimity of contact between the work and roll can be improved to a large extent sufficient to prevent impartment of torsion into the work during the rolling operation at the final stand.

When the upper limits of the various ranges specified above are violated, therefore, the total reduction is correspondingly increased, thus being responsible for occurrence of increasingly ununiform plastic flow in the work being rolled, as the plastic flow is very delicate, so that the work tends to distort and that the width expansion is increased, thereby it being made difficult to control the dimensions of the finished product with high accuracy. When the lower limits are violated, because of the unduly small axial ratio of the initial stock, the first and second stands can not serve to prevent occurrence of torsional moment of the work by the third stand which will result in a decrease of the accuracy of dimensional control.

Figure 3:
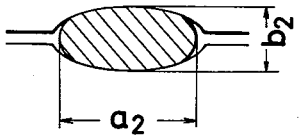
FIG. 3 is a diagram of geometry considered in defining the groove configuration of the No. 1 and No. 2 stands.

According to the present invention, there are further specific requirements for the shaping pass of the second stand. At first, this pass must be formed to an oval opening configuration or likewise configuration having an equivalent function thereto, because the final or third stand is provided with a round opening configuration or likewise configuration having an equivalent function thereto, as will be readily understood by those skilled in the art. The cross-sectional shape of the work to be formed by this second pass must be specified to account for the facts that, in order for the successing or third stand to provide finished products with improved dimensions, the reduction from the second stand to third stand is required to be as small as possible, and that the second stand must function as an entrance guide for supporting the work against the third stand. On this account, according to the invention, this cross-sectional shape is specified in terms of the axial ratio defined in connection with FIG. 3, wherein that portion of the work which is bited between the rolls of the second stand is shown as assuming a possible cross-section area of oval configuration in the shaping pass, and wherein the length of the cross-section of the work measured in coincidence with the roll gap center line is designated by $a_2$, and the length of the cross-section measured in coincidence with a line perpendicular to the roll gap center line and passing through the center of the length $a_2$ is designated by $b_2$. From FIG. 3 on, we call $a_2.b_2$ the axial ratio referred to. The specific range of values for the axial ratio is from 1.09 to 1.31 when the finish gauge is of low level, and from 1.05 to 1.21 when of high level.

The fourth feature of that the intermediate gauge to which the above sepcified starting stock is to be rolled through the first and second stands is specified as follows: The intermediate rolled product be oval in cross-section or analogous thereto, having for the final gauge of low level the major axis ranging from 1.0712D + 0.52 mm to 1.1865D + 0.45 mm and the minor axis ranging from 0.985D − 0.1 mm to 0.998D, and having for the final gauge of high level the major axis ranging from 1.0412D + 1.52 mm to 1.1035D + 3.65 mm and the minor axis ranging from 0.985D to 0.998D (mm).

Figure 4:
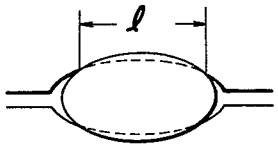
FIG. 4 is a diagram of geometry considered in defining the contact length of No. 2 stand.
Figure 5:
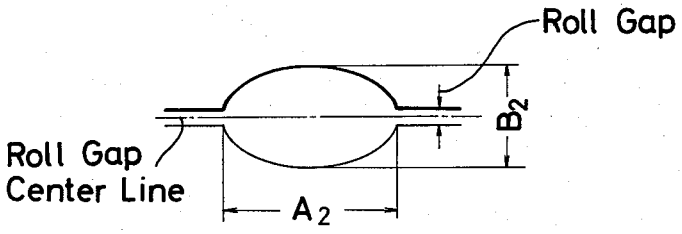
FIG. 5 is a diagram of geometry considered in defining the groove width of the No. 1 and No. 2 stands.

In order to insure that the rolling of the work can be carried out without causing the impartment of torsion to the work, it is of importance to require that the length of contact between the peripheral surface of the workpiece and the roll profile in the second stand as defined by $l$ in connection with FIG. 4 is maximized. As the size and configuration of that portion of the workpiece which is introduced in the second stand and the groove height of the second stand can not be subject to large change, it is proven that the maximization of the contact length, $l$, can be realized only be increasing the radius of curvature of the groove of the second stand. Increasing this radius of curvature will, however, cause approach of the pass to more round configurations which results in a decrease in the ability of the second stand as the entrance guide against the third stand. It follows that there must be set forth a compromise between the requirements of maximizing the contact length, $l$, and of fulfilling the foregoing specific requirement. This compromise is related to the groove width defined in connection with FIG. 5, wherein the distance between the two points at which the oval groove profile curve intersects the left and right flat roll surfaces constituting roll gaps together with the respective surfaces of the opposed roll is designated by $A_2$ which we call the groove width referred to. This definition of the groove width applies to the initial or first stand to be described later, in which also the groove width is referred to as $A_1$ and the minor diameter as $B_1$. A specific range of values for this groove width ($A_1$ or $A_2$) is from 1.1412D + 2.02 mm to 1.2565D + 1.95 mm when the finish gauge is of low level, and from 1.0912D + 4.02 mm to 1.1535D + 6.15 mm when of high level, and specific range of values for the minor diameter $B_1$ or $B_2$ is from (0.985D − 0.1) mm to 0.998D for the finish gauge of low level and 0.985D to 0.998D for the finish gauge of high level. The minor diameter $B_1$ or $B_2$ represents a distance between two points at which a line perpendicular to the roll gap center line and passing through a central point of the groove interdects the upper and lower roller profile curves in the respective stand.

Consideration will now be given to the groove configuration of the first stand. The first stand is positioned on the work entrance side of the second stand, and is operated in such a way that a slight reduction is imposed on the work in the second stand. For this purpose the minor diameter of the groove of the first stand is made sligthly larger than that of the second stand. From the point of preventing the twisting or torsion of the rolling work, it is desirable that the groove width of the first stand is equal or almost equal to that of the second stand so as to give uniform reduction all around the rolling work in the second stand.

The first stand has its own function. Thusly, the first stand maintains a required attitude of the work piece so as to stabilize its attitude at the time of biting in the second and third stands.

According to the present invention, the first and the second stands are spacedly arranged with a specific distance therebetween as mentioned later, and the work piece is held at least at points, namely by the first and second stands so that the twisting or torsion of the work piece being rolled is completely prevented in the third stand.

As understood from the above description, the first stand as well as the second stand is essential, and without the first stand, the desired results of the present invention can not be obtained. On the other hand, however, an additional stand or stands similar to the first stand may be provided before the first stand without deviating from the scope of the present invention.

Further according to the present invention, the three stands of the character described above are arranged in unison with the limitation of the distance between the adjacent stands for the purpose of preventing occurrence of torsion of the work being rolled. On this account, according to the present invention, there are set forth two specific requirements, one of which is that the distance between the roll centers of the first and second stands be made not larger than (5.6D + 400) mm, and another requirement which is that the distance between the roll centers of the second and third stands be made not larger than (4.6D + 320)mm. It is desirable that the above distances are as short as possible from the structural requirements of the stands. If the distances are longer than the above upper limits, torsion of the work piece being rolled appears in the third stand. Unlike the prior art, the present invention operates with a slight reduction for each of the first, second and third stands, so that the size of each of the work rolls can be decreased very much to readily fulfill the above specific requirements.

The present invention is advantageous because the starting stock as defined herein can be produced by the conventional art including the conventional continuous rolling method.

According to the present invention, the slight reduction rolling prevents occurrence of torsion of the work being rolled and provides finished rolled products with dimensional errors falling within a range of ±0.1 to 35 0.20 mm depending upon the sizes of the products.

We have now discovered that the finish rolling to round cross-sectional shape can be performed with the limitation of the total reduction to very small orders to effect an increase in the accuracy of dimensional control for the finishes so produced over the heretofore attained level. In this connection, it should be explained that, as the reduction is minimized, use can be made of work rolls of smaller diameters with decrease in the size of each of the roll stands so that the distance between the roll axis of the successive two stands is decreased. Further, when the total reduction is made on smaller orders, the absolute value of width expansion of the part of the work-piece being rolled which is bited by a pair of rolls forming a pass becomes smaller with decrease in absolute error in estimating the width expansion. Therefore, it is possible to evaluate the cross-sectional area of that part of the work-piece which assumes the rolling pass previously with higher precision, and further to minimize the absolute value of variation of the width expansion which will be caused by the introduction of tension and compression. In addition thereto, the elongation of that part of the work-piece which extends forwardly beyond the first roll stand can be also minimized to make it easier to regulate the volume speeds in such a manner as to maintain the tension and compression at minimum during the entire rolling process.

The advantages of the present invention will be more specifically illustrated below:

1. The dimensional accuracy of the final product is very high, and secondary workings such as drawing step can be omitted, so that the production cost can be lowered remarkably.

2. Complicated speed control as conventionally required in the rough and intermediate steps are no more necessary, thus lowering the capital cost remarkably.

3. No space is required for forming a loop etc., so that the mill line can be shortened and power consumption required by the mill operation and control can be saved.

4. A final product of dimensional accuracy as obtained by the conventional art can be made very easily without dimensional control meter equipments.

Further, the dimensional condition of the starting and finishing ends of the rolled product can be improved remarkably, so that rejects decreases improving the production yield.

5. As the rolling mill embodying the present invention is so small that it can be easily added to the existing equipment or freshly equipped in a new mill line.

Figure 6:
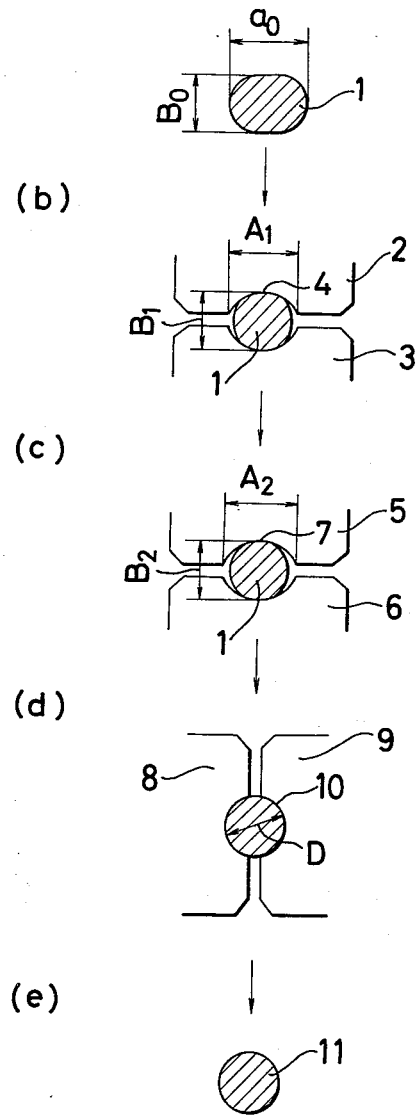
FIG. 6*a, b, c, d,* and *e,* are sequential schematic illustrations of one embodiment of a three-stand rolling mill train including cross-sectional views of the work from the initial and finishing stages according to the present invention.

Referring now to FIG. 6, there is shown one embodiment of the finish rolling method according to the present invention. A starting stock 1 (FIG. 6*a*) is rolled to a thickness, $b_1$, by a pair of horizontal rolls 2 and 3 of No. 1 stand forming an oval groove 4 or likewise groove with a groove width $A_1$ and a minor diameter $B_1$ (FIG. 6*b*), then to a thickness, $b_2$, by a pair of horizontal rolls 5 and 6 of No. 2 stand forming an oval groove 7 or likewise groove with a groove width $A_2$ and a minor diameter $B_2$ (FIG. 6*c*) and then to a round cross-sectional shape of finish gauge by a pair of vertical rolls 8 and 9,No. 3 stand forming a round groove 10 or likewise groove (FIG. 6*d*) whereby a rolled product 11 having highly improve finish dimensions (shift error from the true round within a range of ±0.1 to ±0.20 mm depending upon the size of the finished product) can be obtained (FIG. 6*e*).

Figure 7:
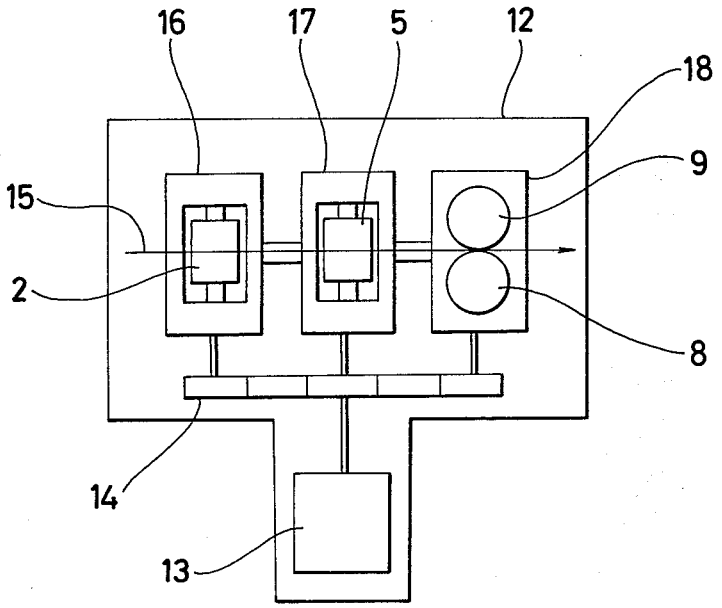
FIG. 7 is a schematic top plane view of the rolling mill according to the present invention.

FIG. 7 shows a schematic plan view of a rolling mill comprising the No. 1, No. 2 and No. 3 stands of FIG. 6 unified in a single frame 12 and associated with a mill motor 13 and a reduction gear train 14. 15 is a pass line. 16 is No. 1 stand of the horizontal roll type, 17 is No. 2 stand of the horizontal roll type, and 18 is No. 3 stand of the vertical roll type.

Figure 8A:
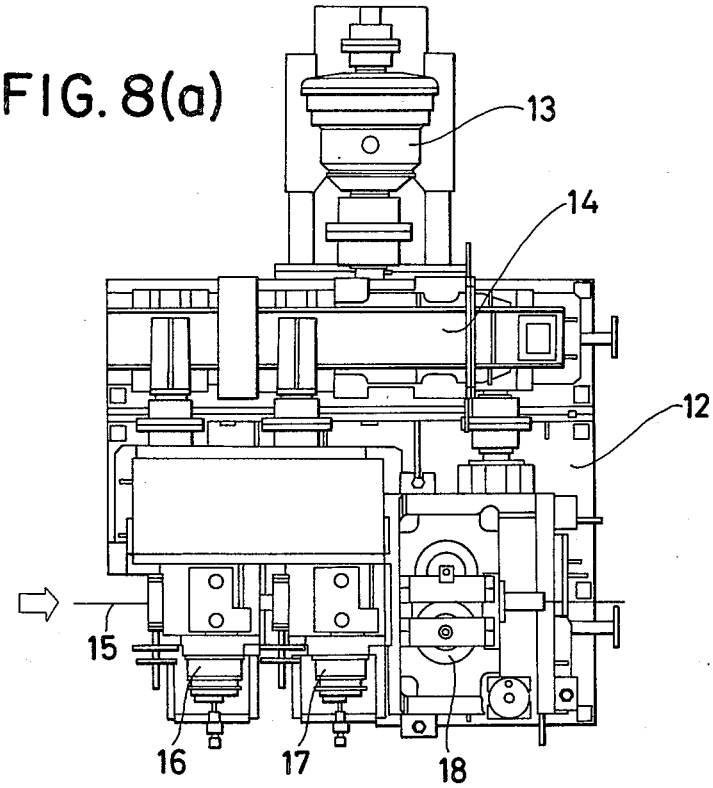
FIGS. 8A and 8B are, respectively, top plane and side elevational views of a practical example of the rolling mill of FIGS. 6 and 7.
Figure 8B:
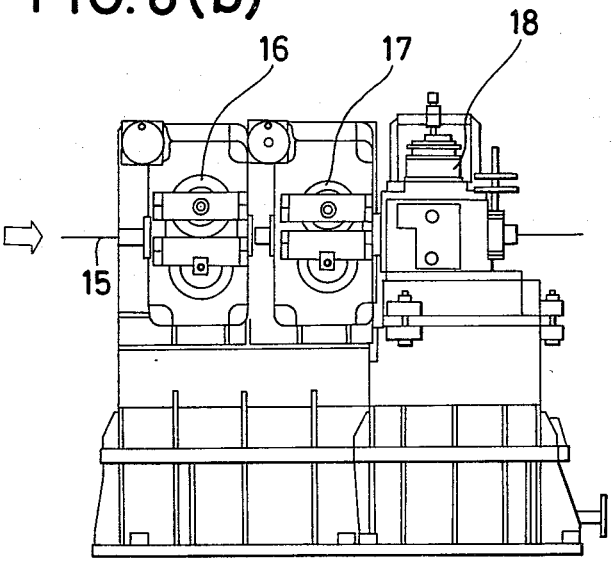

FIG. 8 shows the details of the rolling mill of FIG. 7. The rotational speed of the motor 13 is reduced by the gear train 14 to a predetermined speed at which the rolls incorporated in the stands 16, 17 and 18 are driven for rotation.

The above mentioned rolling mill train is composed of a succession of the first horizontal-type stand, the second horizontal-type stand and the third vertical-type stand, but may composed of an alternative succession of the first vertical, the second vertical and the third horizontal stand to effect an equivalent result to the above, provided that all the specific requirements of the invention are fulfilled.

EXAMPLE 1

In rolling a carbon steel JIS-S45C for mechanical construction to a round bar of 11.0 mm in diameter at a temperature of 900° C and a rolling speed of 20m/sec., use was made of the succession of roll stands of FIG. 6. The numerical values of the various design parameters were as follows. The unit is in millimeter.

Starting stock:

$a_0 = 12.65 \pm 0.3;$ $b_0 = 11.6 \pm 0.3$

No. 1 stand:

$A_1 = 15.45;$ $B_1 = 10.98$

No. 2 stand:

$A_2 = 15.4;$ $B_2 = 10.8$

No. 3 stand;

$D = 11.13$

The thus produced finish of round bar was found to have a diameter of 11.0 ± 0.1 mm.

EXAMPLE 2

In rolling a carbon steel JIS-S15C for mechanical construction to a round bar of 70 mm in diameter at a temperature of 800° C and a rolling speed of 1.7m/sec., use was made of the train of roll stands of FIG. 6. The numerical values of the various design parameters were as follows. The unit is in millimeter.

Starting stock:

$a_0 = 74.60 \pm 0.3$;

$b_0 = 71.50 \pm 0.3$

No. 1 stand:

$A_1 = 75.15$;

$B_1 = 69.86$

No. 2 stand:

$A_2 = 75.64$;

$B_2 = 69.54$

No. 3 stand:

$D = 71.05$

The thus obtained finish of round bar was found to have a diameter of 70 ± 0.13 mm.

The present invention has been described in connection with the rolling of steel material for the finish gauge of 5 up to 200 mm in cross-sectional size. However, it is evident that the present invention is applicable to the rolling of other metals for finish gauges outside that range without diminishing the above mentioned effectiveness.

What is claimed is:

1. A finish rolling method of metal products of round sectional shape comprising:

a. Introducing a starting material of oval cross-sectional shape into a finish rolling train comprising at least a first, a second and a third stand arranged close to each other in the stated order from an inlet side of the train;

b. rolling the starting material into an oval cross-sectional shape with a light reduction from the same direction in the first and second stands; and c. finish rolling in the third stand the thus light reduced oval material into a round cross-sectional shape with a light reduction in a direction almost perpendicular to the reduction direction in the first and second stands, wherein the starting material has a cross-sectional dimension as below:

1. when a final product of 5 to not more than 40 mm diameter is to be obtained; then the Major diameter = (1.07D + 0.5)mm ~ (1.18D + 0.4)mm and the Minor diameter = (1.01D + 0.2)mm ~ (1.05D + 0.4)mm, and 2. when a final product of 40 to not more than 200 mm diameter is to be obtained; then the Major diameter = (1.04D + 1.5)mm ~ (1.10D + 3.5)mm and the Minor diameter = (1.01D + 0.2)mm ~ (1.02D + 1.5)mm and wherein the starting material which has been rolled in the first and second stands has a cross-sectional dimension as below:

1. when a final product of 5 to not more than 40 mm diameter is to be obtained; then the Major diameter = (1.0712D + 0.52)mm ~ (1.1865D + 0.45)mm and the Minor diameter = (0.985D − 0.1)mm ~ 0.998Dmm, and 2. when a final product of 40 to not more than 200 mm diameter is to be obtained; then the Major diameter = (1.0412D + 1.52)mm ~ (1.1035D + 3.65)mm and the Minor diameter = 0.985Dmm ~ 0.998Dmm, the distance of the roll center of the first stand and that of the second stand being not longer than (5.6D + 400)mm and the distance between the roll center of the second stand and that of the third stand being not longer than (4.6D + 320)mm and wherein the rolling groove of the first and second stands has a cross-sectional dimension as below:

1. when a final product of 5 to not more than 40 mm diameter is to be obtained; then the Major diameter = (1.1412D + 2.02)mm ~ (1.2565D + 1.95) mm, the Minor diameter = (0.985D − 0.1)mm ~ 0.998Dmm, and 2. when a final product of 40 to not more than 200 mm diameter is to be obtained; then the Major diameter = (1.0912D + 4.02)mm ~ (1.1535D + 6.15)mm, the Minor diameter = 0.985D ~ 0.998Dmm in which D is the distance between two points at which a straight line perpendicular to the roll gap center line and passing through a central point of the third stand groove intersects the upper and lower roll profile curves in the third stand.

* * * * *